United States Patent [19]

Miller

[11] 4,435,073

[45] Mar. 6, 1984

[54] TONER REMOVAL APPARATUS

[75] Inventor: Richard L. Miller, Burnsville, Minn.

[73] Assignee: Xerox Corporation, Stamford, Conn.

[21] Appl. No.: 408,341

[22] Filed: Aug. 16, 1982

[51] Int. Cl.[3] ..... G03G 15/00

[52] U.S. Cl. ..... 355/15; 355/3 DD; 118/652; 430/125; 15/1.5 R

[58] Field of Search ..... 355/15, 3 R, 3 DD, 14 D; 430/123, 125; 118/652, 656; 5/1.5 R

[56] References Cited

U.S. PATENT DOCUMENTS

| | | | |
|---|---|---|---|
| 2,832,977 | 5/1958 | Walkup et al. | 15/1.5 |
| 3,572,923 | 3/1971 | Fisher et al. | 355/15 |
| 3,722,018 | 3/1973 | Fisher | 15/1.5 |
| 3,780,391 | 12/1973 | Leenhouts | 15/1.5 |
| 4,123,154 | 10/1978 | Fisher | 355/15 |
| 4,127,327 | 11/1978 | Rezanka | 355/15 |
| 4,185,910 | 1/1980 | Nomura et al. | 355/15 |
| 4,361,922 | 12/1982 | Karal | 15/1.5 R |

*Primary Examiner*—A. C. Prescott

[57] ABSTRACT

Cleaning apparatus for removing toner from a photoconductor. The apparatus is characterized by a housing in which a cylindrical brush is supported for rotation. The housing has an opening communicating through a conduit with a vacuum source. A plurality of flicker bars mounted in an airstream created by the vacuum source are fabricated from materials which will not only cause the fibers of the brush to become electrostatically charged through wiping contact with the bars but will cause the charge on the brush to reverse at least once for each revolution of the brush, such reversal taking place while the brush fibers are in the airstream.

11 Claims, 2 Drawing Figures

TONER REMOVAL APPARATUS

BACKGROUND OF THE INVENTION

This invention relates to xerographic reproducing apparatus and, in particular, to apparatus for removing toner particles from a charge retentive surface.

More specifically, this invention relates to improved apparatus for cleaning charged toner particles from an electrostatic recording surface of the type suitable for use in the automatic xerographic reproducing process. In the xerographic process, a uniform electrostatic charge is placed upon a photoconductor or photoconductive surface and the charged surface then is exposed to a light image of an original so as to selectively dissipate the charge to form a "latent electrostatic image" of the original. The latent image is then developed by depositing finely divided charged toner particles upon the photoconductive surface, the charged toner being electrostatically attracted to the "latent electrostatic image" areas to create a visible replica of the original. The developed image is then usually transferred from the photoconductive surface to a final support material and the toner image is fixed thereto to form a permanent record corresponding to the original.

In the practice of automatic xerography, a photoconductive surface is generally arranged to move in an endless path through the various processing stations of the xerographic process. When the photoconductive surface is reusable the toner image is then transferred to a final support material such as paper or the like, and the photoconductor is prepared to be used once again in the reproducing process. Although a preponderance of the toner image is transferred to the final support material during the transfer operation, some of the toner material forming the image commonly referred to as residual toner is unavoidably left behind on the photoconductive surface. This residual toner must be removed from the surface in some manner to avoid degrading subsequent copies reproduced on the photoconductor. Optimumly, the residual toner is removed without redeposition onto the photoconductor.

One of the most successful and widely used methods of cleaning residual toner material from a photoconductive surface is by means of a brush rotated in contact with the photoconductor at a relatively high rate of speed. U.S. Pat. No. 2,832,977 issued to Walkup discloses a rotatable brush mounted in close proximity to the photoconductive surface to be cleaned and the brush is rotated so that the brush fibers continually wipe across the photoconductor in a manner to produce the desired cleaning. In order to reduce the dirt level within the machine, a vacuum system is provided which pulls loosely held residual toner particles from the brush fibers and exhausts the toner from the apparatus. To assist the vacuum system in removal of the toner material, Walkup treats his brush fibers with a neutralizing ion spray which is intended to negate any triboelectrification generated when the brush wipes across the photoconductive surface. Although the Walkup vacuum and neutralization system is capable of reducing the dirt level by removing loosely held soils from the brush fibers, it has been found that the brush nevertheless becomes contaminated after extended usage to a point where the brush must be replaced within the cleaning system.

With the advent of new processing techniques and toner materials, machine speeds have now reached a level where the foregoing brush cleaning technique can no longer be effectively utilized. In order to overcome some of the difficulties found in the art, while at the same time preserving the advantages of brush cleaning, Fisher et al in U.S. Pat. No. 3,572,923 devised a cleaning apparatus adapted for use in a high speed automatic reproducing machine. In Fisher, a fibrous cleaning brush, similar to that disclosed by Walkup, is used to remove residual toner particles from a photoconductive surface. However, after the photoconductive surface is cleaned, a second cleaning operation is performed on the brush in which residual toner material collected on the brush is electrostatically transferred from the brush fibers to a biased transfer member. In order to create the proper electrostatic relationship between the cleaning members, Fisher supports his fibrous brush upon a nonconductive core and biases the core in a manner to attract toner from the photoconductive surface toward the brush. Although the biased core arrangement has proven to perform satisfactorily, it has been found that a more efficient cleaning operation can be effected when an electrostatic relationship is established between the brush fiber and the transfer member.

Accordingly, as disclosed in U.S. Pat. No. 3,722,018 a corona generator is positioned to induce a charge in the brush fibers and particles thereon of a polarity opposite that of a biased transfer roll whereby the particles collected by the brush are efficiently transferred from the brush to the roll.

Toner removal from the brush can also be accomplished by the use of an electrically biased flicker bar as illustrated in U.S. Pat. No. 3,780,391 granted to Leenhouts. The Leenhouts device also uses an electrically biased bar which charges the brush prior to its contact with the photoconductor.

Numerous other prior art cleaning devices differing somewhat from those discussed hereinabove have been developed for removing toner from a photoconductor. Most if not all of them utilize some sort of electrical biasing scheme to establish suitable electrostatic forces for either attracting or repelling the charged toner particles.

Methods of creating suitable electrostatic forces without the undesirable expense of electrical biasing arrangements such as discussed above employ one or more flicker bars supported within the cleaner housing such that there is an interference with brush movement which causes the brush fibers to be flexed with subsequent return thereof to their unflexed position. Such flexing causes a flicking action. With such a cleaning device it has been observed that toner redeposits on the photoconductor particularly under stress conditions. Stress conditions are the use of an older brush, extreme envirnonmental conditions such as high relative humidity, solid area residual toner, trying to clean some of the finer toner particles which have recently come into use and high preclean biases.

Certain xerographic machines experience what has come to be referred to as the extended line problem. Simply stated, it is the inability of the brush cleaner to remove lines that come to the cleaner straight-on. One way of solving the extended line problem is to increase the preclean bias. However, when increasing the preclean bias it was discovered that the increased charge on the photoconductor aggravated the redeposition problem.

Thus, what is needed is a brush cleaning apparatus which is relatively inexpensive and which is capable of extending the life of the brush, better able to remove solid area residual toner, possesses a greater operational latitude and precludes redepositon.

SUMMARY OF THE INVENTION

In accordance with the apparatus of the present invention there is provided an improved toner cleaning apparatus of the type that uses a rotary brush and a plurality of flicker bars which minimizes toner redeposition, extends brush life, more effectively cleans solid areas, is effective over a wide range of humidity and allows higher preclean biasing to eliminate the extended line problem.

Redeposition is precluded to a high degree primarily by the provision of a cleaning apparatus which more effectively removes the toner from the brush. To this end, the cleaner of the present invention comprises a cylindrical brush fabricated from Dynel (Trademark of Union Carbide Corporation) fibers which is mounted for rotation at a relatively high speed and adapted to wipe against the photoconductor surface to thereby remove the toner therefrom. Once the brush fibers, impregnated with toner, leave the photoconductor they impinge upon a first Teflon (Trademark of E. I. duPont) flicker bar which is supported in the housing within an airstream such that it interferes with the brush movement thereby causing the fibers to flex after which they return to their non-flexed position. The fibers proceed into contact with a second Teflon bar which serves the same purpose as the first bar, this second bar also being supported in the airstream. In addition to the flicking action, the Teflon bar causes the brush fibers to take on positive electrostatic charges. A first discharge bar is also mounted in the airstream beyond the second Teflon bar. The material of the first discharge bar is chosen so that it causes the brush fibers to become negatively charged through the wiping action therebetween. The material of the discharge bar may be, by way of example, Delrin (Trademark of E. I. duPont). An important aspect of the invention is that the three bars discussed are positioned in the path of an airstream which is created by a suitable vacuum source and the cleaner housing. Thus, the toner removed from the brush by the flicking action of the three bars aided by the interaction of the electrostatic forces of the brush and the toner is carried out of the cleaner housing by the airstream. A second Delrin bar is supported adjacent the vacuum opening but to the opposite side thereof from the three other bars. It acts primarily as an air baffle but also charges the brush negatively. Therefore, the bulk of the air passing around the brush fibers is directed across the other three bars to thereby enhance toner removal.

Teflon is generically known as polytetrafluoroethylene. Delrin is generically known as acetal resin and Dynel is generically known or as a copolymer of vinyl chloride and acrylonitrile.

While the reason why the toner is more efficiently removed from the brush, thus providing an improved cleaner, in that, toner redeposition onto the photoconductor is precluded is not well understood, it is believed that the triboelectrification of the brush fibers by the plural Teflon bars is such that the fibers more readily shed the toner into the airstream than prior art devices. Moreover, the triboelectrification of the brush by the Delrin bars is believed to cause any minor quantitites of toner not removed from the brush by the Teflon bars to either remain in the brush when it again contacts the photoconductor or be propelled into the airstream depending upon the polarity of the toner, or both. It is believed that the brush charge reversal in a single revolution of the brush which charge reversal takes place with the brush fibers in the airstream plays an important role in the effectivenes of the cleaner of the present invention. As the result of investigating the toner redeposition problem exhibited by a Xerox 9200 (Trademark of Xerox Corporation) machine that had a Delrin flicker bar and a Teflon lubricator bar, the latter of which was used for coating and thereby lubricating the photoconductive surface, I found that if the interference and contact area between the brush and the existing Delrin bar were increased a decrease in redeposition of toner occurred under both light and heavy toner concentration conditions. I further discovered that if at least one Delrin bar (charges brush negatively) and plural Teflon bars (charges brush positively) are located in the airstream an optimum cleaner apparatus resulted.

As indicated above, it is felt that effectiveness of the cleaning device of the present invention is due to the effective removal of toner from the brush which, in turn, optimizes its cleaning capability. It can be theorized that the provision of the two types of bars (i.e. positive and negative charge generators) positioned in the airstream will be effective to remove toner including particles with positive and negative charges. Since there are two Teflon bars for charging the brush fibers positively and since the majority of the toner is positively charged (i.e. toner rendered positive by the positive preclean corotron) then the positive toner is more effectively repelled by positive brush fibers or at least not likely to be held to the fibers during flicking. Also, the negatively charged particles could be repelled with simultaneously flicking action into the airstream by the Delrin bar which causes the brush fibers to become negatively charged. Regardless of the theory of operation there has been provided by the present invention an effective cleaning apparatus which works better: with aged brushes; under a wider range of environmental conditions such as relative humidity; for cleaning solid areas and which allows an increased preclean bias which solves the extended line problem.

BRIEF DESCRIPTION OF THE DRAWINGS

For a better understanding of the invention reference is had to the following detailed description of the invention to be read in conjunction with the accompanying drawings, wherein.

DETAILED DESCRIPTION OF THE PREFERRED EMBODIMENT

Figure 1:
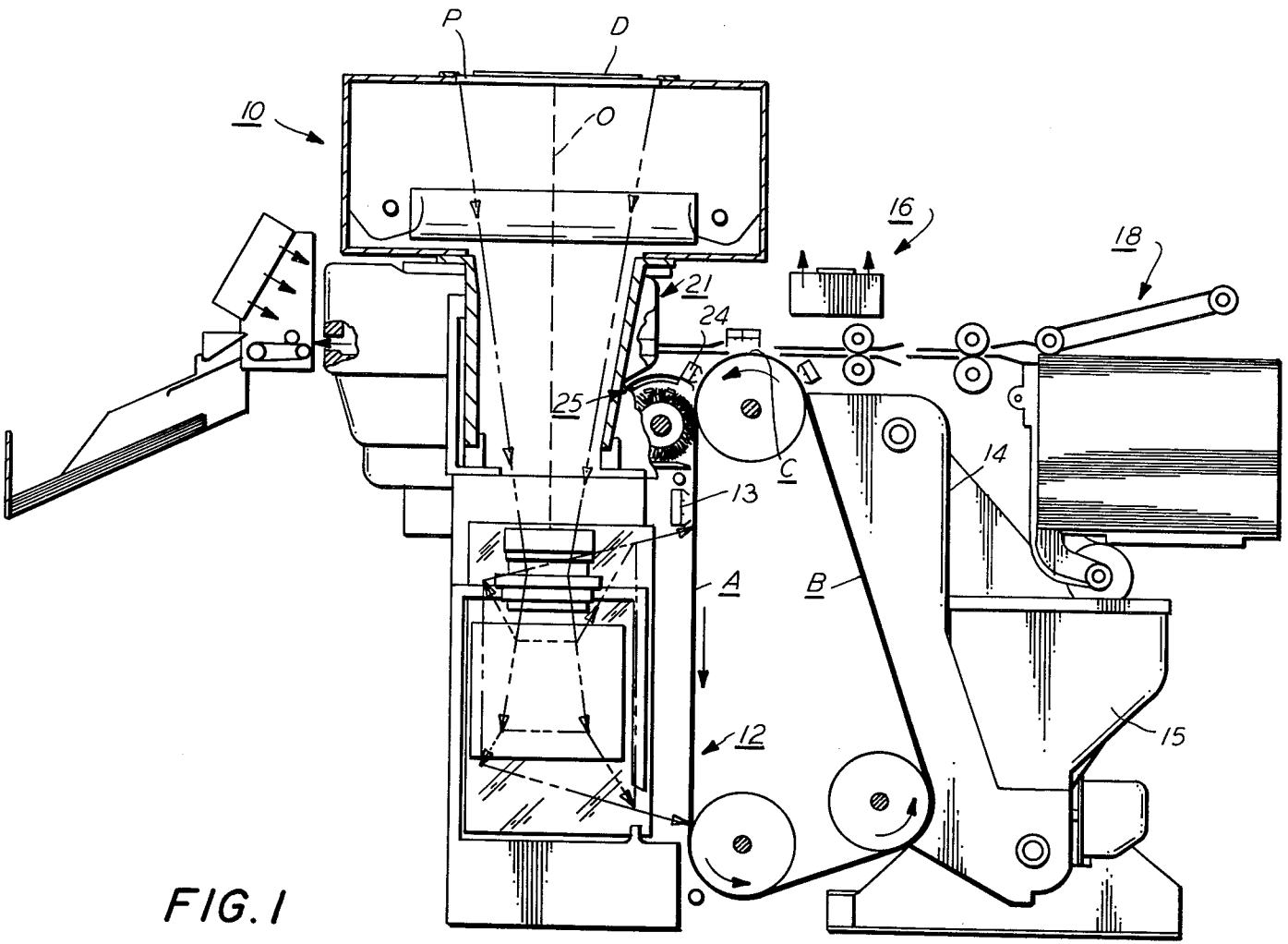
FIG. 1 is a schematic sectional view of a reproduction machine incorporationg the present invention therein with the processing components in section to better illustrate the environment for the present invention.

For a general understanding of the illustrated copier/reproduction machine, incorporating the invention, reference is had to FIG. 1 in which the various system components for the machine are schematically illustrated. As in all electrostatic systems such as a xerographic machine of the type illustrated, a light image of a document to be reproduced is projected onto the uniformly sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fixed by a fusing device whereby the powder image is caused to permanently adhere to the support surface.

In the illustrated machine, an original to be copied is placed upon a transparent support platen P fixedly arranged in an illumination assembly generally indicated by the reference numeral 10, arranged at the left end of the machine. While upon the platen, an illumination system flashes light rays upon the original thereby producing image rays corresponding to the informational areas on the original. The image rays are projected by means of an optical system for exposing the photosensitive surface of a xerographic plate in the form of a flexible photoconductive belt 12 arranged on a belt assembly slidably mounted upon a support bracket secured to the frame of the machine and which is adapted to drive the belt 12 in the direction of the arrow at a constant rate. During this movement of the belt, the reflected light image of an original on the platen is flashed upon the xerographic surface of the belt. The belt surface that intercepts the light rays comprises a layer of photoconductive material such as selenium on a conductive backing that is sensitized (i.e. is uniformly charged with positive charges prior to exposure by means of a charging corona generator device indicated at 13.

The flash exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes through a developing station B in which there is positioned a developer assembly generally indicated by the reference numeral 14 and where the belt is maintained in a flat condition. The developer assembly 14 comprises horizontally and vertically conveying mechanisms which carry developing material to the upper part of the belt assembly whereat the material is dispensed and directed to cascade down over the upwardly moving inclined selenium belt 12 in order to provide development of the electrostatic image.

As the developing material is cascaded over the xerographic plate, toner particles in the development material are deposited on the belt surface to form powder images. As toner powder images are formed, additional toner particles are supplied to the developing material in proportion to the amount of toner deposited on the belt during xerographic processing. For this purpose, a toner dispenser generally indicated by reference numeral 15 is used to accurately meter toner to the developer material in the developer assembly 14.

The developed electrostatic image is transported by the belt to a transfer station C whereat a sheet of copy paper is moved at a speed in synchronism with the moving belt in order to accomplish transfer of the developed image. There is provided at this station a sheet transport mechanism generally indicated at 16 adapted to transport sheets of paper from a paper handling mechanism generally indicated by the reference numeral 18 into registry with the developed image on the belt at the station B.

After the sheet is stripped from the belt 12, it is conveyed into a fuser assembly generally indicated by the reference numeral 21 wherein the developed and transferred xerographic powder image on the sheet material is permanently affixed thereto. After fusing, the finished copy is discharged from the apparatus at a suitable point for collection externally of the apparatus.

The next and final station in the device is a belt cleaning station having positioned therein a corona precleaning device 24 similar to corona charging device to impose an electrostatic charge on the selenium belt and residual powder adherent thereto to aid in effecting the removal of the powder, a belt cleaning assembly 25 including a rotating brush device adapted to remove any powder remaining on the xerographic belt after transfer. A positively biased A.C. potential is supplied to the preclean device 24 which results in the residual toner particles becoming positively charged.

Suitable drive means may be arranged to drive the selenium belt 12 in conjunction with timed flash exposure of an original to be copied, to effect conveying and cascade of toner material, to separate, and feed sheets of paper and to transport the same across the transfer station C and to convey the sheet of paper through the fuser assembly in timed sequence to produce copies of the original.

It is believed that the foregoing description is sufficient for the purposes of this application to show the general operation of an electrostatic copier using an illumination system constructed in accordance with the invention.

Figure 2:
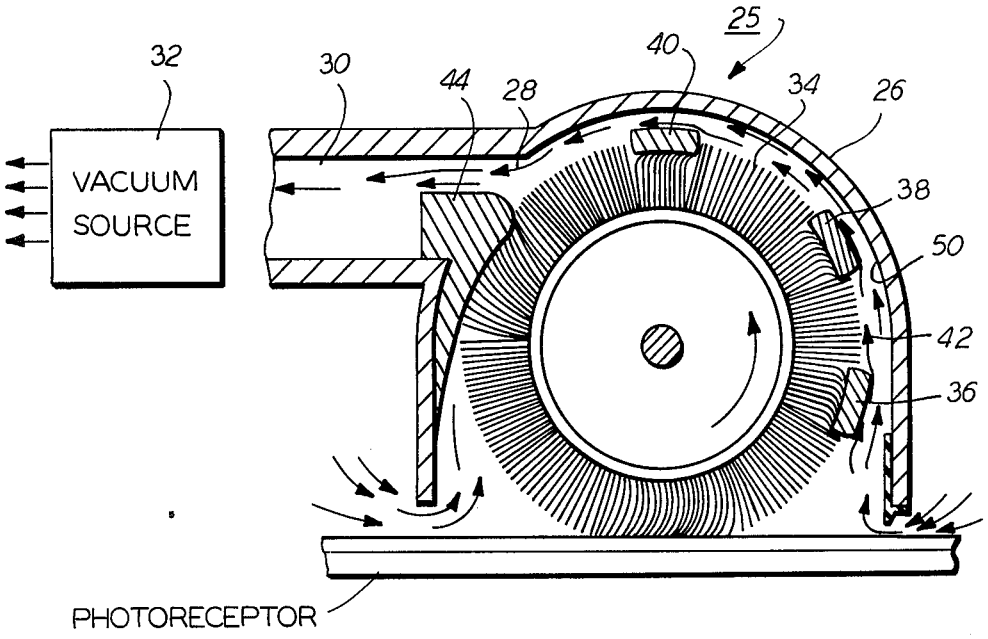
FIG. 2 is an elevational view of the brush cleaning assembly used in the xerographic machine of FIG. 1.

As illustrated in FIG. 2, the cleaning assembly 25 comprises a housing 26 having an opening 28 communicating through a conduit 30 with a vacuum source 32. A cylindrical brush 34 is supported for relatively high speed rotation within the housing 26 and such that it wipes in contact with the belt 12.

First and second Teflon flicker bars 36 and 38 are also supported within the housing 26 so that there is a predetermined (i.e. between 0.115–0.135 inch) interference between each bar and the brush fibers. These bars are preferably fabricated from Teflon when the brush fiber material is Dynel in order that the brush fibers become positively charged when wiped against the Teflon. A first Delrin discharge bar or member 40 is similarly mounted and serves to cause the brush to become negatively charged as the brush fibers wipe thereacross. As can be seen the three bars are supported within an airstream 42 created by the vacuum source 32. Thus, as can be appreciated the charge on the brush will be reversed within a single revolution of the brush. More importantly, the brush charge reversal takes place while the fibers are in the airstream 42. A second Delrin member 44 is positioned adjacent the opening 28 to the opposite side thereof from that of the bars 36, 38 and 40. In this position it also acts as an air seal as well as a discharge member for aiding in the charge reversal of the brush. The airflow creating the airstream 42 is created by the vacuum source and a section 50 of the housing 26 which directs the airstream over the bars 36, 38 and 40.

As will be appreciated by those skilled in the art the materials of the brush and bars are not limited to those specified but the materials employed must effect brush charge reversal, from positive to negative, within a single revolution of the brush and the bars should be positioned such that the charge reversal takes place with the brush fibers in the airstream. Moreover, it will be appreciated that charge reversal need not be from positive to negative since with a different xerographic processor the required reversal could be from negative to positive.

The preclean corotron 24, illustrated in FIG. 1, powered with positively biased A.C. potential serves to neutralize the charges on the toner which initially were negative so that they would be attracted to the positively charged photoconductor. In fact, the toner particles become positively charged just prior to entry into the cleaning zone. The brush 34 which possesses negative charges by virtue of its wiping against the Delrin bars contacts the belt 12 whereby the toner is picked up. Subsequent rotation of the toner laden brush fibers into contact with the Teflon bars causes a flicking action causing the toner to be dislodged from the brush fibers and pass into the airstream. As the fibers wipe against the Teflon bars they become positively charged. Further rotation of the brush fibers causes them to contact the Delrin members which effects brush charge reversal from positive to negative. It is believed that additional toner becomes dislodged when the fibers contact the Delrin bar positioned in the airstream and this additional toner is introduced into the airstream. The Teflon bars are preferably positioned as shown in FIG. 2 at the two and four o'clock positions while the Delrin bar 40 is preferably positioned at the twelve o'clock position and the Delrin member 44 at the ten o'clock position.

I claim:

1. Apparatus for removing toner particles from a charge retentive surface, said apparatus comprising:

a cylindrical brush adapted for rotation in contact with said surface;

first means for interfering with the rotation of said brush to thereby cause fibers of said brush to flex and simultaneously electrostatically charge said brush to a first polarity;

second means for interfering with the rotation of said brush to thereby cause fibers of said brush to flex and simultaneously electrostatically charge said brush to a second polarity; and means for creating an airstream across said first and second means whereby said the charge on said fibers is reversed while said fibers are in the airstream.

2. Apparatus according to claim 1 wherein said first means comprises at least one bar fabricated from polytetrafluoroethylene and said second means comprises at least one bar fabricated from acetal resin and wherein said brush fibers are fabricated from a material which will be charged positively by the polytetrafluoroethylene and negatively by the acetal resin.

3. Apparatus according to claim 2 where said brush fibers comprise a copolymer of vinyl chloride and acrylonitrile.

4. Apparatus according to claims 2 or 3 including a second polytetrafluoroethylene bar positioned between said at least one polytetrafluoroethylene bar and said at least one acetal resin bar.

5. Apparatus according to claim 4 including a second acetal resin bar.

6. Apparatus according to claims 1, 2 or 3 wherein said means for creating an airstream comprises a housing in which said brush is supported, and a vacuum source communicating with said housing through an opening therein.

7. Apparatus according to claim 6 wherein said second acetal resin bar is mounted adjacent said opening to the side thereof opposite the other bars and forming an air seal thereat.

8. Method of removing toner particles from a charge retentive surface, said method including the steps of:

rotating a fiber brush in contact with said charge retentive surface;

rotating said brush into contact with means for electrostatically charging said brush positively and causing the brush fibers to experience a flicking action;

rotating said brush into contact with means for electrostatically charging said brush negatively and causing the brush fibers to experience a flicking action; and creating an airstream that passes over both of said charging means to carry toner particles dislodged from said brush fibers away from said brush.

9. The method of claim 8 further including rotating said brush into contact a second means for electrostatically charging said brush positively and causing the brush fibers to again undergo a flicking action prior to contacting the means for charging the brush negatively.

10. The method of claim 9 including the step of providing a housing around said brush to establish a channel for said airstream for directing the airstream over all of said charging means.

11. The method of claim 9 including the step of rotating said brush in contact with a second means for electrostatically charging said brush negatively after contacting the other negative charging means.

* * * * *

UNITED STATES PATENT AND TRADEMARK OFFICE

CERTIFICATE OF CORRECTION

PATENT NO. : 4,435,073

DATED : March 6, 1984

INVENTOR(S) : Richard L. Miller

It is certified that error appears in the above-identified patent and that said Letters Patent are hereby corrected as shown below:

Claim 1, Col. 7, line 42, delete "said" in the first occurrence.

Signed and Sealed this

*Seventeenth* Day of *July 1984*

[SEAL]

*Attest:*

GERALD J. MOSSINGHOFF

*Attesting Officer*

*Commissioner of Patents and Trademarks*